United States Patent [19]

Parker

[11] 4,129,184

[45] Dec. 12, 1978

[54] DOWNHOLE VALVE WHICH MAY BE INSTALLED OR REMOVED BY A WIRELINE RUNNING TOOL

[75] Inventor: William H. Parker, Hurst, Tex.

[73] Assignee: Del Norte Technology, Inc., Euless, Tex.

[21] Appl. No.: 810,201

[22] Filed: Jun. 27, 1977

[51] Int. Cl.[2] ..... E21B 43/12

[52] U.S. Cl. ..... 166/315; 166/65 R; 166/322; 166/323; 166/72

[58] Field of Search ..... 166/322, 65 R, 315, 166/324, 323, 65 A, 321, 72

[56] References Cited

U.S. PATENT DOCUMENTS

| | | | |
|---|---|---|---|
| 3,032,111 | 5/1962 | Corley, Jr. et al. | 166/65 R |
| 3,310,114 | 3/1967 | Dollison | 166/322 |
| 3,661,205 | 5/1972 | Belorgey | 166/65 R |
| 3,856,085 | 12/1974 | Holden et al. | 166/324 |
| 3,884,300 | 5/1975 | Garrett | 166/324 |
| 3,961,308 | 6/1976 | Parker | 166/72 |
| 3,978,922 | 9/1976 | Johnson et al. | 166/322 |

*Primary Examiner*—Ernest R. Purser

[57] ABSTRACT

A disaster valve for downhole use in a gas or oil well is built into a unitary housing having a wireline running tool connector at one end and a control package at the other end. In the center of the housing, a ball valve (in one embodiment) or a piston and cylinder valve (in another embodiment) is arranged to be operated by a new and improved mandrel driven by a motor for rotating a feed screw. The housing includes passages and parts configured so that the lower end of the housing lies along the axis of the tubing to enable a peripheral fluid flow, coaxially around the housing. Near the valve, the fluid is diverted from the peripheral flow into an axial flow. The valve controls the fluid flow at the point where the peripheral flow converts into the axial flow. During catastrophic conditions, a quick release feature enables the valve to be driven to a closed position under spring tension.

23 Claims, 6 Drawing Figures

DOWNHOLE VALVE WHICH MAY BE INSTALLED OR REMOVED BY A WIRELINE RUNNING TOOL

This invention relates to devices used downhole in an oil or gas well and controlled from the surface, and more particularly to a valve which may be installed at or removed from a point deep in the well by means of a wireline tool lowered from the top of the well.

A number of my patents and copending patent applications show features which have been combined in the structure of this invention. In U.S. Pat. No. 3,961,308, sonic energy is transmitted through the walls of the well tubing to a point downhole where it is detected and used to control a downhole disaster valve. The valve is spring biased toward a shut position, and held open against that bias responsive to the continuous receipt of sonic energy. Therefore, the valve automatically shuts if the sonic energy disappears.

U.S. Pat. No. 3,901,315 shows a ball valve which may be used downhole to control the flow of oil or gas from the well and up the tubing. The ball rotates as it moves up or down between closed and open positions within the tubing. Normally, a spring biased follower pushes the ball upwardly toward a closed position. As long as a sonic energy signal is transmitted down the tubing walls of the pipe line, a hydraulic ram actuator pushes the ball downwardly against the bias of the spring. If the sonic energy disappears (even by destruction of the line itself), the hydraulic actuator releases and the spring pushes the ball to its closed position. One difficulty with this design is that sliding seals between the hydraulic ram and housing wall wear out quickly.

A tool for installing and removing devices in a downhole position is shown in copending U.S. Pat. application Ser. No. 741,855, filed Nov. 15, 1976, by William H. Parker and Lawrence Hart, and entitled "WIRELINE RUNNING TOOL", now U.S. Pat. No. 4,074,762, granted Feb. 21, 1978. This wireline running tool may be used for lowering, seating and leaving devices in an oil line tubing, or for dislodging and removing the devices from their seated positions.

Accordingly, an object of this invention is to provide new and improved valves which may be lowered, installed and removed by wireline running tools.

Another object of the present invention is to combine the features of my prior inventions to provide an oil well valve which may be installed or removed by means of a wireline running tool and which may be controlled by sonic energy transmitted down the tubing.

Still another object of the invention is to provide a new and improved valve which overcomes certain marginal operating characteristics encountered heretofore.

Yet another object of the invention is to provide a completely self-contained unit which combines valves, controls, and all other parts required to provide and control a disaster valve.

A further object of the invention is to eliminate resilient sliding seals (such as O-rings) which have heretofore been subject to severe wear.

In keeping with an aspect of the invention, these and other objects are provided by a valve built into a unitary housing having a wireline running tool connector at one end and a control package at the other end. In approximately the center of the housing, a valve is arranged to be operated by a new and improved mandrel which is moved responsive to a motor driving a feed screw. The housing includes peripheral passages so that fluid flows coaxially around the housing. Near the valve, the fluid flow is diverted into an axial bore, where the valve controls the fluid flow. When the valve is in its open position, a slight additional motion toward the open position releases the valve and a spring quickly drives it shut. Two embodiments of valves are provided. One is a ball valve and the other is a piston sliding in a cylinder.

These embodiments of the invention are shown in the attached drawings wherein.

Figure 1:
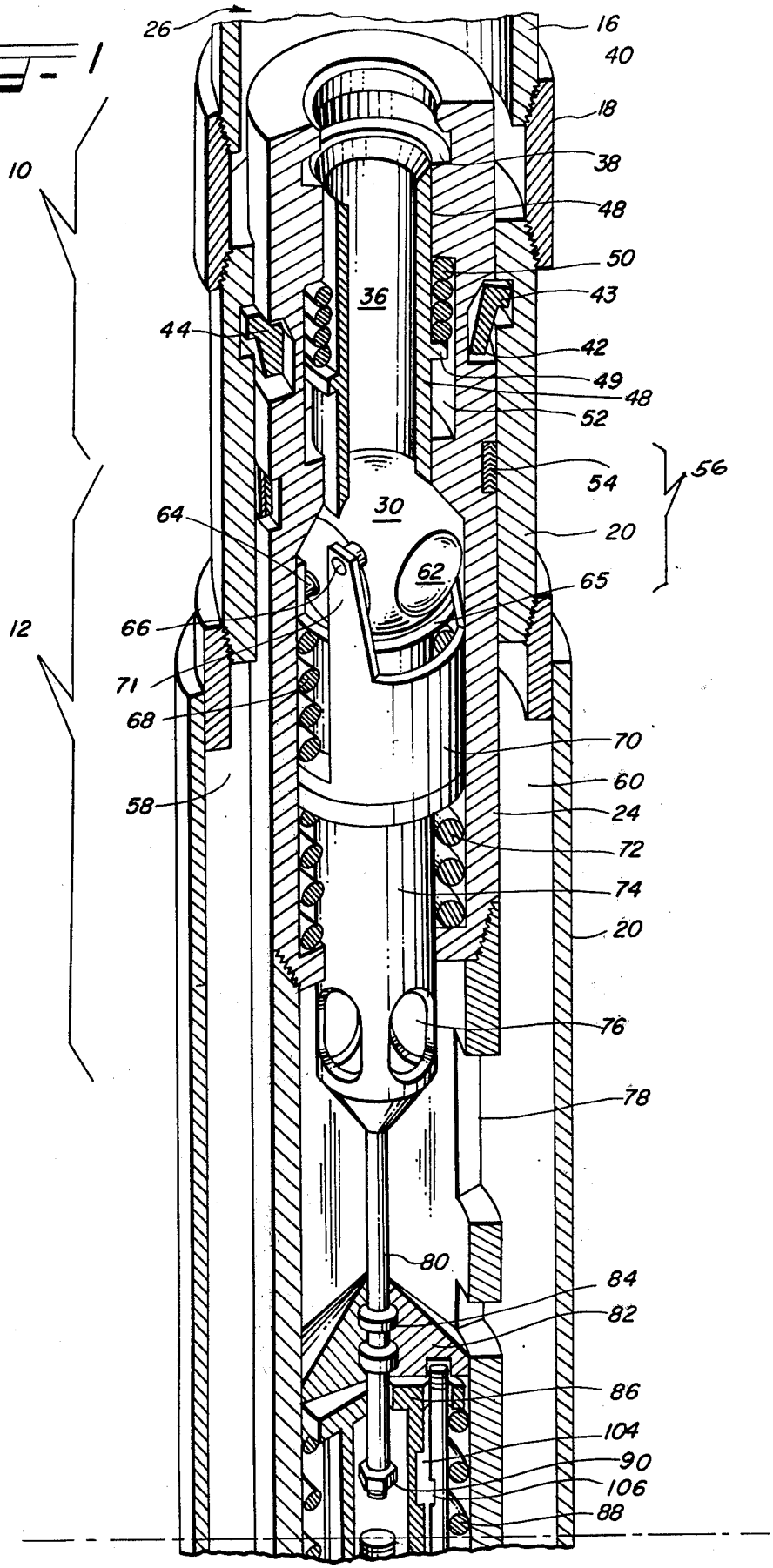
FIG. 1 is a perspective view (partly in cross section) of the inventive valve including the wireline running tool connector on one end and a ball valve for fluid control.
Figures 1, 2, 3:
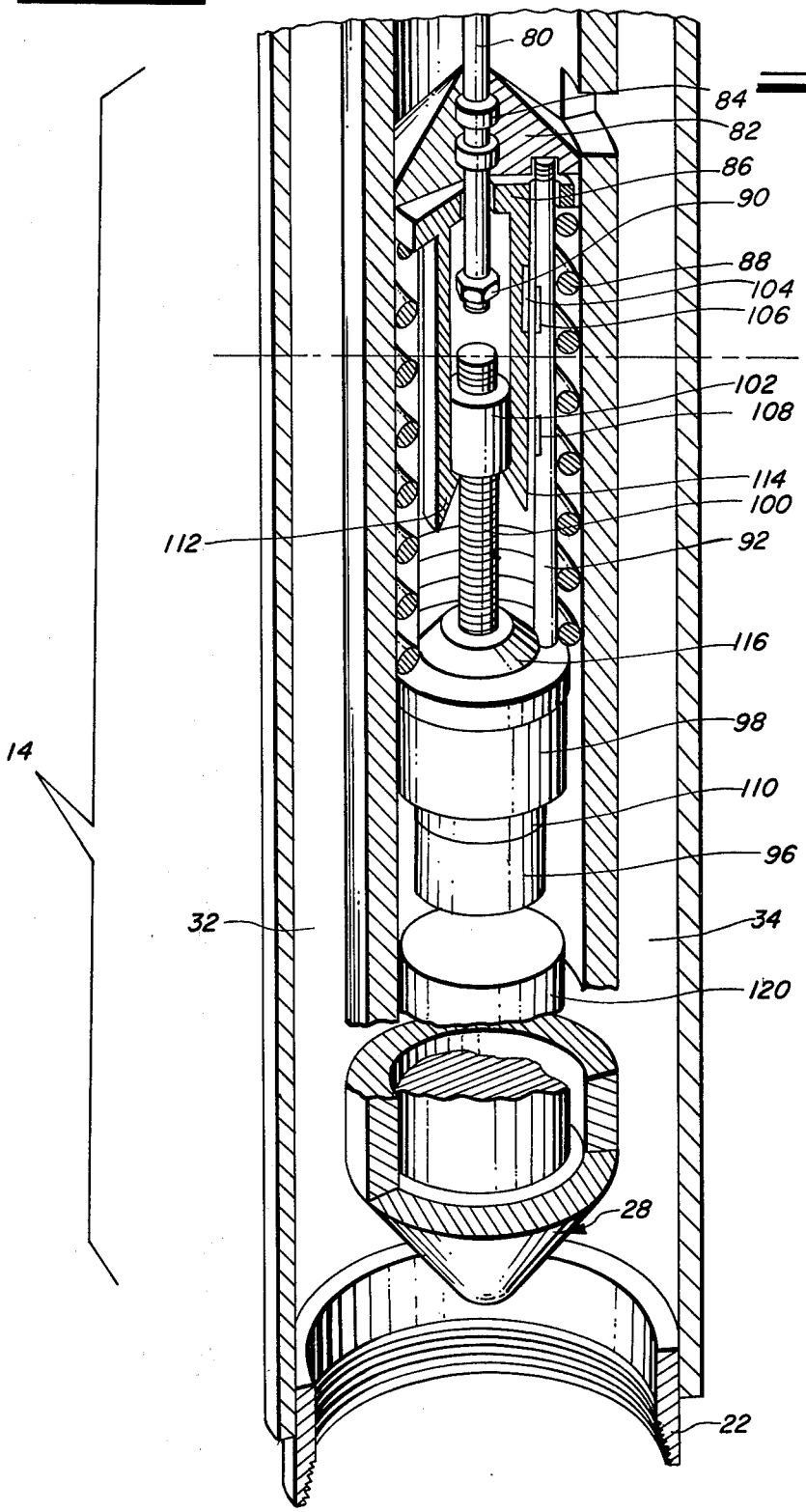
FIG. 2 is a perspective view of a valve control system incorporated in the unitary housing.
FIG. 3 shows how FIGS. 1 and 2 should be joined to provide a complete drawing.

In greater detail, the inventive device shown in FIGS. 1 and 2 comprises a wireline running tool connector 10, a ball valve 12, and a control package 14. The oil line tubing 16 is connected by a coupler 18 to a housing support 20 for the inventive valve and by a coupler 22 to the remainder of the oil line tubing (not shown). The inventive device itself is incorporated in a housing 24 extending from an upper end 26 to a lower end 28.

The ball valve 30 is positioned near the upper end of the housing 24, immediately beneath the wireline running tool connector 10. Beneath the ball valve 30, fluid flows peripherally around the housing 24 (in the region marked 32 and 34, for example). Above the ball valve 30, the fluid flows through an axial bore 36.

The wireline coupler 10 has a running neck 38 comprising a circumferential ledge 40 which is undercut at 38 so that it may be hooked and released by a device which may be lowered and raised through the tubing. The wireline tool (not shown) includes a conically shaped member having controllable latches which fit into the running neck 38 and latch under the ledge 40. The outside of the upper end of the housing 24 includes a circumferential groove 42 which may be captured and released by mating landing lock latches 43, 44 built into the tube line housing support 20.

In operation, a wireline running tool may be lowered down the tubing while it is latched into the running neck 38. The inventive downhole valve device may be lowered through the tubing until the landing lock latches 43, 44 snap into the circumferential groove 42. Thereafter, the tool's latches may be retracted from the neck 38 and the tool may be pulled up the tubing. If it later becomes necessary to remove the inventive downhole device, the wireline running tool is lowered through the tubing until it reaches, enters, and comes to rest in the running neck 38. Then the wireline tool latches are extended to hook under the peripheral ledge 40 and into the running neck 38. The running tool latches and the lock latches 43, 44 may be constructed and controlled in any well known manner.

Coaxially positioned inside the wireline tool connector 10 is a spring biased cylindrical mandrel 48 having a circumferential flange 49 which forms a seat for a surrounding coiled spring 50. The bore 36 for enabling an axial fluid flow is defined by the inner wall of the cylindrical mandrel 48. At all times, the coiled spring 50 urges the flange 49 toward the ball valve, thereby continuously maintaining the mandrel seated upon the surface of the ball valve 30. The clearance space 52 provides sufficient room for the flange 49 to follow the ball movement throughout its entire excursion.

A packing 54 may be any suitable form of gasket or similar material for sealing the valve housing 24 against the inside of the tubing housing support 20. This gasket prevents fluid flowing up the tubing from bypassing the valve, thereby insuring that the fluid will flow through the bore 36 and will be controlled by the ball valve 30.

In the region 56 of the inventive structure, the fluid flow passage converts from a peripheral flow into an axial flow. That is, before the fluid reaches the region 56, it flows through the circumferential passage including the spaces 58, 60. After the region 56, the fluid flows through the axial bore 36. The ball valve 30 controls the flow at the point where the conversion occurs.

In greater detail, the ball 30 includes an axial bore 62 which penetrates the ball and provides a continuation of the axial bore 36 when the ball 30 is rotated to align these two bores 36, 62. However, when the ball is rotated so that these two bores 36, 62 do not communicate, the valve is closed and the lower end of the mandrel 48 is sealed against an unbroken segment of the outer surface of the ball 30. The spring 50 holds the mandrel in its sealing engagement with the ball.

The ball 30 is restrained by a pair of oppositely disposed pins (one of which is seen at 64) which are securely anchored in a ball support mandrel 65. These pins are restrained in slots (not shown) formed in the ball so that it may both roll and slide through the tube. In addition, associated with the ball 30 is a second pair of pins (one of which is seen at 66) which are securely anchored to a ball rotating mandrel. Again, this second pair of pins also fit into a second pair of slots to enable the ball 30 to roll back and forth within the housing 24. The four pins represented by pins 64, 66 have a mutually rectilinear relationship.

From an inspection of the drawings, it should be obvious that the ball rotates to align the bores 36 and 62 (open the valve) when the pins 66 move upwardly (as viewed in the drawings). Conversely, the ball 30 rotates so that the bores 36, 62 do not communicate (close the valve) when the pins 66 move downwardly. During this motion, the pins 64 stabilize and guide the ball. Also during this motion, the mandrel 48 rides on the surface of the ball, compressing and expanding the spring 50, as the ball 30 moves up and down in the housing 24.

Resilient link means, spring 68, is a pressure equalization device positioned beneath the ball supporting mandrel 65 to drive it upwardly in the valve housing. This spring is a resilient link between the ball valve and the means for pulling the valve open for preventing the valve from opening when there is excessive downhole pressure.

In greater detail, the valve housing 24 contains a section of relatively large diameter having a ball rotating mandrel 70 slidingly received therein. A pair of upstanding ears (one of which is seen at 71) on the mandrel 70 carry the pins 66 which engage and move the ball 30. Spring 68 is captured between the bottom of the ball support mandrel 65 and an upper surface of a spring seat formed on the rotating mandrel 70, in order to urge the ball 30 upwardly at all times, thereby assisting in a maintenance of the seating relationship between the ball 30 and the bottom of the mandrel 48. If the ball is subject to unequal pressures when an open command is received, the spring 68 may compress and the valve may not open because pins 64, 66 slide without changing their relative positions with respect to the ball. When the ambient pressures equalize, the spring 68 returns to its normal extension and the ball valve may open as pins 64 move up relative to pins 66. Beneath the ball rotating mandrel 70 is a second coiled spring 72 which continuously urges the ball 30 toward a closed valve position.

Rigidly connected to the bottom of the ball rotating mandrel 70 is a ball follower 74, which is a hollow cylindrical member having a plurality of ports (as at 76, for example) formed in the bottom thereof. Fluid flowing up the peripheral part of the tubing passes through the ports 76 and 78, the interior of the ball follower 74, the bore 62 (when the valve is open), the bore 36, and up the tubing 16 to the surface.

Connected to and integrally movable with the ball follower 74 is a valve operating tension rod 80 which slides through a bulkhead 82 that is permanently affixed inside the valve housing. Any suitable packing 84 is provided within the bulkhead 82 to prevent the fluid in the pipe from leaking around the rod 80.

Beneath the bulkhead 82, and in the part of the housing which is free of the fluid flowing in the tubing, there is a rod pulling mandrel 86. A lift spring 88 normally pushes the rod pulling mandrel 86 upwardly to assist the springs 68, 72 in driving the ball 30 to a closed position.

To open the valve, the rod pulling mandrel 86 moves downwardly and the spring 88 is compressed. The mandrel 86 eventually encounters a nut 90 on the valve operating tension rod 80. Thereafter, a continued pulling of the rod 80, by the mandrel 86, lowers the ball follower 74, which in turn pulls the ball rotating mandrel 70 downwardly. The play provided by the distance which the mandrel 86 travels before it engages the nut 90 eliminates almost all need for precise adjustments.

As the ball rotating mandrel 70 and its pins 66 move downwardly, the ball 30 rotates to align the bores 36, 62. When the rod pulling mandrel 86 moves upwardly, all of the springs cooperate to raise the ball rotating mandrel 70 and its pins 66. The pins 66 engage the ball 30 and rotate it so that the bores 36, 62 no longer communicate. One or more supporting rods 92 guide and direct the rod pulling mandrel 86 as it moves up and down.

The motive power for controlling the opening and closing of the valve is provided by an electrical motor 96, connected through a reduction gear train 98 to a ball screw 100, which is threaded through a nut 102 associated with the rod pulling mandrel 86. Thus, if the motor 96 drives the screw 100 in one direction, the nut 102 is lowered to pull the ball to an open valve position. If the motor 96 reverses its direction of rotation, the ball valve raises to a closed valve position.

A magnet 104 is permanently mounted on and movable with the rod pulling mandrel 86. As the mandrel moves up or down, the magnet operates upper and lower limit switches 106, 108. These limit switches open the circuit to energize the motor 96 and thereby control the extent of the rod pulling mandrel excursion and the ball valve movement. A brake 110 is selectively controlled to prevent a rotation of the ball screw 100 at all times except when the motor 96 is positively being driven.

For emergency or catastrophic valve closures, the lower end of the rod pulling mandrel 86 terminates in a pair of hooks 112, 114 for capturing the ball screw nut 102. When the ball valve 30 is opened, the limit switch 108 will have stopped these hooks 112, 114 in a position which is immediately above a conical disengaging cam 116. Therefore, if an emergency should occur, a few additional rotations of the ball screw 100 cause hooks 112, 114 to engage the cam 116, which spreads them far enough apart to release the ball screw nut 102. At this time, the springs drive the ball home very quickly — up to 100 times faster than other presently used valves.

It is presently thought that, after such a catastrophic valve closure, the valve should not be able to open responsive to signals transmitted downhole. Therefore, a preferred procedure requires the valve to be pulled up the tube and to be either reset at the surface or replaced entirely.

Of course, the arrangement may also be such that, if the motor is driven far enough in the valve closing direction, the ball screw nut 102 is driven again into the grasp of the hooks 112, 114. Once the ball screw nut is so recaptured by the rod pulling mandrel, the valve may resume its normal operation.

The motor 96 is controlled by an electronic circuit 120. This circuit preferably responds to sonic energy transmitted down the walls of the tube line. However, it may also be controlled in another well known manner.

Figure 4:
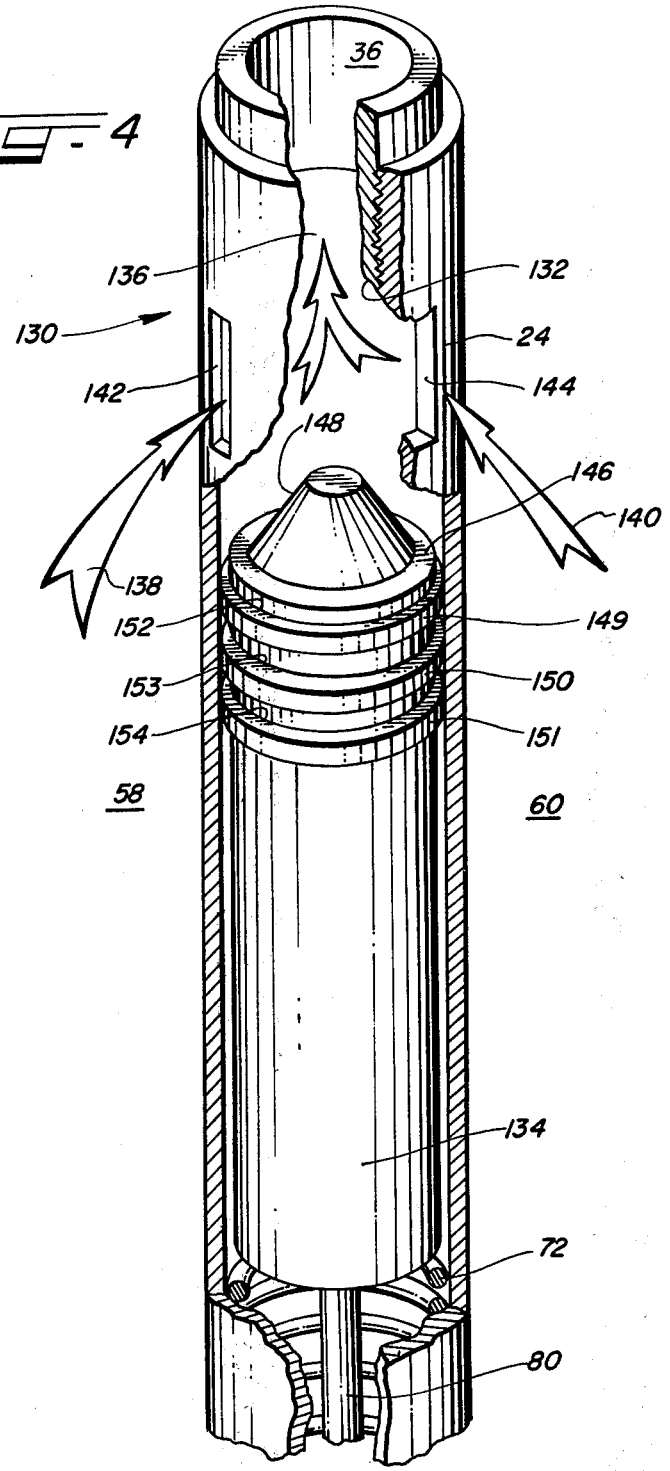
FIG. 4 is a perspective view, partly in cross section, showing an open valve position of a second embodiment of the inventive valve using a piston and cylinder valve.
Figure 5:
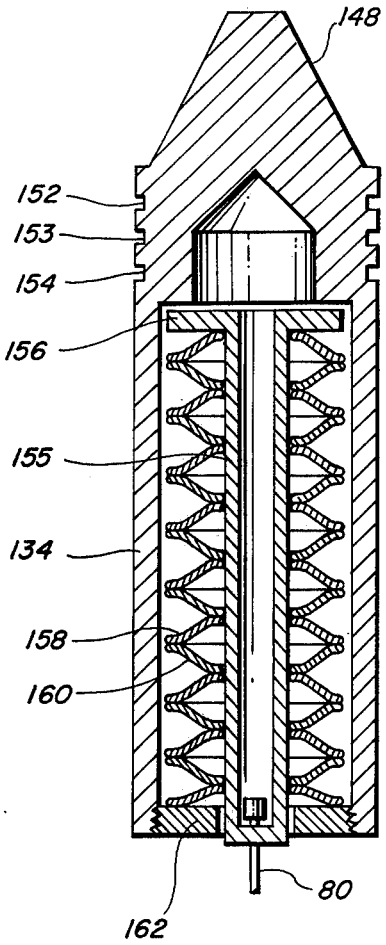
FIG. 5 is a cross-sectional view of the piston valve, per se, of FIG. 4.
Figure 6:
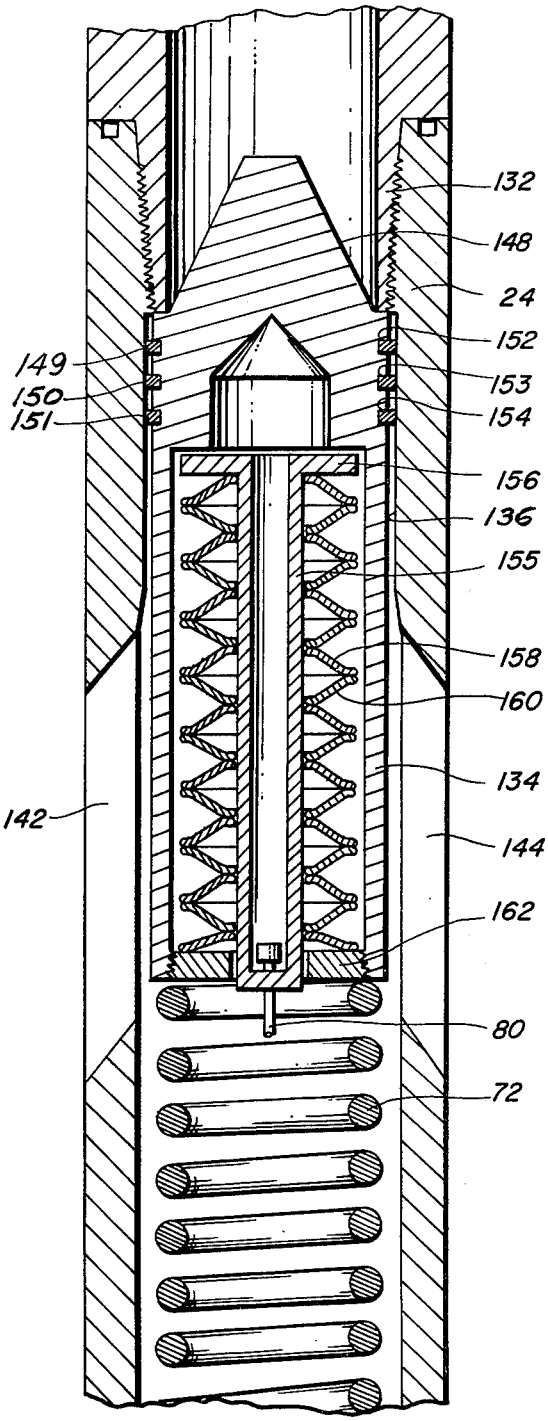
FIG. 6 is a cross-sectional view of the same piston and cylinder valve in a closed valve position.

A second embodiment of a downhole valve 130 is seen in FIGS. 4–6. This valve may be substituted for the ball valve 30 in FIG. 1. The FIG. 4 piston valve closing spring 72 may be the same as the ball valve closing spring 72 in FIG. 1. The piston valve operating rod 80 (FIG. 4) may be the same as the ball valve operating rod 80 in FIG. 1. A valve seat 132 (FIG. 4) may be located above the valve, in the general area of the housing that is occupied by the mandrel 48 and the bore 36 of FIG. 1. This valve seat 132 may be a short section of pipe threaded into the walls of the housing 24.

The valve of FIGS. 4–6 includes a piston 134 which can slide up and down inside a cylinder 136. Piston 134 is pulled down and into the open valve position seen in FIG. 4. Then fluid 138, 140 flowing up the peripheral passageway 58, 60 (FIGS. 1 and 4) may enter any suitable number of slots 142, 144 through the cylinder wall and exit through the central bore 36. When the piston 134 moves up the cylinder 136, the periphery of its top 146 seats itself against the bottom of the valve seat 132 (FIG. 6). This closes the valve and blocks the flow of the fluid 138, 140.

The outside of the piston 134 is constructed as seen in FIG. 4, and its interior is constructed as seen in FIG. 5. The top of the piston terminates in a generally conical crown section 148 which guides, directs and centers the piston in the bore 36. At the base of the conical crown section 148 is the circumferential seat 146 which abuts against the valve seat 132, when the valve is closed.

A plurality of piston rings 149, 150, 151 are seated in mating circumferential grooves 152, 153, 154 (FIG. 5) formed in the piston 134. These piston rings are made approximately the same as piston rings used in an internal combustion engine. The metallurgy of the rings is well known and the rings are extremely wear resistant. They greatly outlast the rubber-like O-rings conventionally used to form sliding seals in downhole valves. These piston rings 149–151 slide inside the walls of the cylinder 136 and actually provide the seal against fluid flow through the valve when it is closed.

As seen in FIGS. 5 and 6, the interior of the piston 134 is a hollow cylinder lying coaxially with the piston. This hollow cylinder contains a stem 155 (also coaxial with the piston and hollow) having a perpendicular disc 156 integrally formed at its top. Between the disc 156 and the bottom 162 of piston 134 are a number of Bellville springs (two of which are numbered 158, 160), which form a resilient link between the piston and the pulling rod 80. Each of these Bellville springs is inverted relative to its two adjacent neighbors. For example, the base of the spring 158 is pointing toward the bottom 162 of the piston 134, and the base of the spring 160 is pointed toward the top 148 of the piston. A moment's reflection should make it apparent that these springs behave somewhat as a resilient accordion bellows would behave.

The Bellville springs 158, 160 behave as spring 68 behaves in the embodiment of FIG. 1, in that excessive downhole pressure keeps the valve from closing. More particularly, if the valve is commanded to open when there is excess downhole pressure, the piston 134 is held in an upward or a closed position by the force of such pressure, which is greater than the resilience of the Bellville springs. Therefore, these springs 158, 160 compress and the disc 156 is able to move downwardly when the stem 155 is being pulled by the rod 80 while downhole pressure holds the piston valve 134 in its shut position. When the downhole pressure reduces to a level which is less than the force of springs 158, 160, they drive the valve piston 134 downwardly to an open position.

Another use for the Bellville springs 158, 160 is to jar the valve if it should become stuck. The stem 155 may be pulled and the disc 156 may be moved downwardly. Then, the stem may be released to cause the springs to drive the disc 156 upwardly against the housing of the piston valve. If desired, the quick release feature may be used to open the grip of the springs 112, 114, which will cause the disc 156 to snap back to its relaxed spring position, thereby striking a blow against the interior wall of the piston 134. The nut 102 may then be driven back into the grasp of springs 112, 114, to repeat the blow.

The invention departs from present practice by a complete inversion of the operating system. The sonic energy detector is now located at the bottom of the system and the valve is located at the top of the system. Furthermore, the system offers a more intrinsically fail-safe mode of operation.

Philosophically, a valve closing spring is compressed in such a way that the energy required to shut the well is contained in the spring. Earlier practice has been to drive a hydraulic ram means which shoves the ball to compress this spring. The inventive system approaches the problem from the standpoint that the only task required of the downhole system is to compress the valve closing spring. The valve operator provides a fail-safe way to cause the spring to be released whenever the valve is to be slammed shut under emergency conditions.

A number of advantages are realized by the invention. First, the invention provides a structure which does not use a hydraulic ram. Therefore, the valve does not contain a conventional ram-type of sliding seal (e.g., an O-ring), which has been the most unreliable component in the prior art valves. Second, the valve is actuated by pulling a very small diameter rod, which is relatively easy to seal by the only sliding seal. Third, the system operates substantially independent of the setting depths. Insofar as valve operation is concerned, ambient pressure acts only upon a sliding seal on the small rod 80, which is relatively unaffected by pressure due to the small area exposed to the ambient pressure. This is different from the excessive pressure which may slam or hold a valve shut. Fourth, the mechanical drive unit 96 provides a mechanical means to crank the valve open and hold the springs in tension so that the valve will always fail shut. This method of operation uses minute amounts of power from a battery to place the spring under tension. Fifth, the valve closes more quickly than hydraulic ram controlled types of valves because a capillary line between the valve and its controller is eliminated.

Those who are skilled in the art will readily perceive how various modifications may be made, without departing from the invention. Therefore, the appended claims are to be construed to cover all equivalent structures.

I claim:

1. A downhole valve which is free of wireline connections with the surface, said valve comprising an elongated unitary housing having a wireline running tool connector means at one end and a control package means at the other end, valve means near the center of the housing mounted for undertaking an excursion in a first direction to an open position at a discrete distance within said housing, spring means for normally urging said valve to move in an opposite direction over said discrete distance to a closed position, and means controlled by said control package means responsive to signals transmitted downhole for moving said valve in said first direction against the urging of said spring means and over said discrete distance to said open position, said valve thereafter remaining in said open position without requiring a continuous energy drain at said valve.

2. The valve of claim 1 wherein said wireline tool connector means comprises an undercut neck portion which may be latched into responsive to a signal transmitted downhole from the top of the well line tubing.

3. The valve of claim 2 wherein said wireline connector further comprises a plurality of landing locks and a circumferential groove in said housing which may be seized by said landing locks.

4. A downhole valve comprising a unitary housing having a wireline running tool connector means at one end and an electronic control package means at the other end, ball valve means secured near the center of the housing by a pair of opposed pins secured in the housing and fitting into a pair of opposed slots on said ball valve, said ball valve means including operating means comprising a spring biased mandrel having a second pair of pins fitting into a second pair of slots on said ball for rolling said ball valve responsive to mandrel movement, said spring bias normally urging said ball valve to a valve closed condition, the housing including a lower end passage below said valve and mandrel which enables a peripheral fluid flow coaxially around the housing, and a central bore near and above the ball valve, the fluid being diverted from said peripheral flow into an axial flow through said bore, the ball valve means being located above the lower end passage and below the central bore for controlling the fluid flow near the approximate point where the peripheral flow converts into the axial flow.

5. The valve of claim 4 and means attached to said mandrel for raising and lowering said mandrel in said housing and therefore for operating said ball valve, and motor driven means for operating said raising and lowering means.

6. The valve of claim 5 and a bulkhead for sealing the housing in the area between the mandrel and the motor, said raising and lowering means comprising a small diameter rod extending through a packing in said bulkhead whereby said rod is acted upon by downhole pressures distributed over a minimum area.

7. The valve of claim 6 wherein said motor driven means comprises a feed screw extending between said motor and said small diameter rod, said feed screw being fed into a nut associated with said small diameter rod whereby a turning of said feed screw raises and lowers said nut and said small diameter rod.

8. The valve of claim 7 wherein there is a lost motion coupling between said nut and said small diameter rod, whereby said valve fits together with minimum tolerance requirements.

9. A downhole valve comprising a unitary housing having a wireline running tool connector means at one end and a control package means at the other end, ball valve means secured near the center of the housing by a pair of opposed pins secured in the housing and fitting into a pair of opposed slots on said ball valve, ball valve operating means comprising a spring biased mandrel having a second pair of pins fitting into a second pair of slots on said ball for rolling said ball valve responsive to mandrel movement, said spring bias comprising a pair of springs positioned respectively above and below said ball valve operating mandrel, said spring bias normally urging said ball valve to a valve closed condition, the housing including a lower end passage which enables a peripheral fluid flow coaxially around the housing, and a central bore near the ball valve, the fluid being diverted from said peripheral flow into an axial flow through said bore, the ball valve controlling the fluid flow at the point where the peripheral flow converts into the axial flow.

10. The valve of claim 9 and a hollow cylindrical ball follower means attached to the bottom of said valve operating mandrel, and a plurality of ports in said cylinder for diverting fluid flow from said peripheral flow into said axial flow.

11. A downhole valve comprising a unitary housing having a wireline running tool connector means at one end and a control package means at the other end, ball valve means secured near the center of the housing by a pair of opposed pins secured in the housing and fitting into a pair of opposed slots on said ball valve, ball valve operating means comprising a spring biased mandrel having a second pair of pins fitting into a second pair of slots on said ball for rolling said ball valve responsive to mandrel movement, said spring bias normally urging said ball valve to a valve closed condition, the housing including a lower end passage which enables a peripheral fluid flow coaxially around the housing, a central bore near the ball valve, the fluid being diverted from said peripheral flow into an axial flow through said bore, the ball valve controlling the fluid flow at the point where the peripheral flow converts into the axial flow, means attached to said mandrel for raising and lowering said mandrel in said housing and therefore for operating said ball valve, motor driven means for operating said raising and lowering means, a bulkhead for sealing the housing in the area between the mandrel and the motor, said raising and lowering means comprising a small diameter rod extending through a packing in said bulkhead whereby said rod is acted upon by downhole pressures distributed over a minimum area, said motor driven means comprising a feed screw extending between said motor and said small diameter rod, said feed screw being fed into a nut associated with said small diameter rod whereby a turning of said feed screw raises and lowers said nut and said small diameter rod, and quick release means for releasing said nut from said association with said small diameter rod, whereby said spring biased mandrel shuts said ball valve.

12. A downhole valve free of wirelines extending from the surface downhole to said valve, said valve being for use in a pipe line of an oil, gas or similar well, said valve further comprising an elongated cylindrical housing having a circumferential valve seat formed near one end thereof, cylinder means extending in one direction away from said valve seat and through said housing, inlet port means piercing the walls of said cylinder in at least one location displaced in said one direction away from said valve seat, piston means sliding in said cylinder between a first position against said valve seat and a second position on a side of said inlet port means which is opposite the side containing said valve seat, spring means for urging said piston means to said first position, means responsive to signals transmitted down said pipe line to move said piston means to said second position, and at least one metallic piston ring sealing the space between the wall of the piston and the wall of the cylinder.

13. The valve of claim 12 and a wireline running tool connector means on the upper end of said housing, a control package means on the lower end of said housing operated responsive to sonic energy transmitted downhole in order to hold said valve open without requiring a continuous drain of energy, and means for attaching said housing in or detaching said housing from a landing means in said pipe line responsive to manipulation by a wireline running tool attached to said connector means.

14. A downhole valve for use in a pipe line of an oil, gas or similar well, said valve comprising an elongated cylindrical housing having a circumferential valve seat formed near one end thereof, cylinder means extending in one direction away from said valve seat and through said housing, inlet port means piercing the walls of said cylinder in at least one location displaced in said one direction away from said valve seat, piston means sliding in said cylinder between a first position against said valve seat and a second position on a side of said inlet port means which is opposite the side containing said valve seat, said piston containing a hollow cylinder which is coaxial with said piston, stem means coaxially mounted for reciprocal motion within said hollow cylinder, spring means seated on one end of said hollow cylinder for normally urging said stem toward the other end of said hollow cylinder, spring means for urging said piston means to said first position, means responsive to signals transmitted down said pipe line to move said piston means to said second position, and said means for moving said piston to said second position comprising means for pulling said stem toward said one end of said hollow cylinder whereby the force of said pull is transmitted through said spring to said piston so that said piston will not move to said second position if the counterforce of downhole pressure exceeds the force of said spring.

15. The valve of claim 14 wherein said spring means comprises a plurality of axially aligned Bellville springs which are alternatively inverted, with respect to neighboring springs.

16. A pressure equalized downhole valve comprising an elongated housing having a longitudinally movable valve centrally located in said housing, means for normally urging said valve means to a closed valve position, means for moving said valve against said normal urging to an open valve position, and pressure responsive resilient means interposed between said valve and said valve moving means whereby said valve remains in said closed valve position if downhole pressure overcomes the upward thrust produced by said resilient means.

17. The valve of claim 16 wherein said valve comprises a ball valve and said resilient means comprises a coiled spring interposed between said valve moving means and said ball valve.

18. The valve of claim 16 wherein said valve comprises a piston having at least one Bellville spring interposed between said valve moving means and said piston valve.

19. A process for controlling the flow of fluid through a downhole well tubing, said process comprising the steps of:

(a) lowering a valve downhole through said tubing by means of a wireline running tool, (b) seating said valve in a landing which is coaxial with said tubing, (c) biasing said valve via resilient coupling means resisted by downhole pressure to a closed position whereby said fluid flow is normally blocked by said valve when it is seated in said landing, and (d) pulling said valve via said resilient coupling means and against said bias to an open valve position responsive to signals sent downhole from the top of the well, whereby said valve will not open responsive to said pulling when the downhole pressures exceed the resilience of said coupling means.

20. The process of claim 19 wherein said signals are sonic energy signals transmitted downhole via the walls of said tubing.

21. The process of claim 19 wherein said pulling means is a feed screw fed through a nut associated with said valve, and the added step of releasing said nut responsive to emergency conditions, whereby said biased valve slams shut.

22. The process of claim 21 and the added step of turning said feed screw to drive said nut back into association with said valve after said valve has slammed shut.

23. The process of claim 21 and the added step of controlling said valve responsive to a rod having a minimum cross-sectional area, whereby any movement of said rod encounters a minimum of resistance responsive to ambient downhole pressure.

* * * * *